US007169028B1

(12) United States Patent
Barton, II

(10) Patent No.: US 7,169,028 B1
(45) Date of Patent: Jan. 30, 2007

(54) FLEXIBLE FINISHING SHOE

(76) Inventor: Kenneth A. Barton, II, 1305 S. Cedar Suite 506, Lansing, MI (US) 48910

( * ) Notice: Subject to any disclaimer, the term of this patent is extended or adjusted under 35 U.S.C. 154(b) by 0 days.

(21) Appl. No.: 11/265,262

(22) Filed: Nov. 2, 2005

(51) Int. Cl.
*B24B 1/00* (2006.01)
*B24B 49/00* (2006.01)

(52) U.S. Cl. ..... 451/490; 451/163; 451/540; 51/165.91; 51/165.74

(58) Field of Classification Search ..... 451/490, 451/163, 540, 21; 51/154, 165.91, 165.74
See application file for complete search history.

(56) References Cited

U.S. PATENT DOCUMENTS 4,682,444 A * 7/1987 Judge et al. ..... 451/49
5,058,325 A * 10/1991 Pineau ..... 451/317
5,095,663 A * 3/1992 Judge et al. ..... 451/25
5,490,808 A * 2/1996 Jantschek et al. ..... 451/59
5,522,762 A * 6/1996 Pineau ..... 451/163

* cited by examiner

*Primary Examiner*—Lee D. Wilson
*Assistant Examiner*—Anthony Ojini

(57) ABSTRACT

A flexible finishing shoe for finishing a workpiece have a bearing surface and an adjacent side, the flexible finishing shoe comprising a shoe base having a first side and an opposing second side and a finishing body disposed between the first and second sides, the finishing body made from a flexible non-metallic material capable of conforming to the bearing surface and adjacent side.

20 Claims, 4 Drawing Sheets

FLEXIBLE FINISHING SHOE

TECHNICAL FIELD

This invention relates generally to a flexible finishing shoe for a finishing arm and more particularly to a flexible finishing shoe which is capable of conforming to any workpiece surface shape.

BACKGROUND OF THE INVENTION

"Microfinishing" or "superfinishing", as it is known in the art, is a surface finishing process wherein a grinding means is brought to bear against a workpiece which has been previously rough ground. Microfinishing is a low velocity abrading process which generally follows rough grinding. Because microfinishing incorporates lower cutting speeds than grinding, heat and pressure variants may be minimized to provide improved size and geometry control. Those skilled in the art recognize that surface quality or roughness is measured in roughness average values ($R_a$) wherein $R_a$ is the arithmetical average deviation of minute surface irregularities from hypothetical perfect surfaces. Microfinishing can provide surface quality of approximately 1 to 10 μin. (0.025 to 0.25 μm). Bearing surfaces of crankshafts, cam shafts, power transmission shafts in similar machine components that rotate on journal bearing surfaces generally require this surface finish for satisfactory operation.

Conventional mass production microfinishing machines have the ability to finish all the bearing surfaces on a workpiece in one operation. These machines contain a plurality of abrasive tape segments which are aligned with respect to the bearing surfaces. In operation, the workpieces are rotated as the microfinishing machine causes abrasive tape segments to contact and thus finish the bearing surfaces. These large multi-abrading machines are capable of successive steps in one operation including rough grinding, grinding and microfinishing.

As is common in large scale production, failures may occur at one or more of the grinding areas or abrasive tape positions. As a result, workpieces may be produced with one or more bearing surfaces (but less than all bearing surfaces) which are not finished to the required surface quality specifications. In such cases, the grinding machine operator must then remove and scrap the defective workpiece. Because microfinishing is the final stage in surface treatment operations, i.e. after rough grinding and grinding, the scrapping of microfinished parts results in a substantial loss of both material and labor to the machinist.

Microfinishing processes are used in automotive applications in the manufacture, repair and rebuilding of internal combustion (IC) engines. Such engines not only require finely finished bearing surfaces for engine efficiency, but also for increased durability and longevity. In the initial manufacturing stage, crankshaft and camshaft bearing surfaces are microfinished to particular roughness specifications by previously mentioned, conventional mass production microfinishing machines.

In the repair or rebuilding stages, engine components such as crankshafts and cam shafts from faulty engines or older engines, are removed and reground to remove ten to thirty-thousandths of an inch of stock from the existing bearing surfaces. The bearing surfaces of these components are then polished or microfinished by placing the respective workpieces on a lathe and manually bringing a microfinishing material in contact with the rotating bearing surfaces. This microfinishing material is often a section of abrasive material mounted on a support correspondingly shaped to the bearing surface. It is generally recognized in the industry that these manual finishing operations are inadequate for achieving finished surfaces of standard quality.

Automotive repair and rebuilding operations reclaim and refinish workpieces from hundreds of various internal combustion engines with different designs. New and small engine crankshafts, remanufactured crankshafts, high performance crankshafts and diesel crankshafts also may require special finishing. Programmably controlling a finishing machine to accept each individual workpiece that requires microfinishing from different internal combustion engines is uneconomical and inefficient.

SUMMARY OF THE INVENTION

The flexible finishing shoe of the present invention has been developed to meet the need for a surface finishing shoe that is able to adequately and consistently finish the transition from a crankshaft bearing surface outside diameter to the raduised portion.

Accordingly, it is an object of the present invention to provide a flexible finishing shoe for a finishing arm including a shoe base having a first side and an opposing second side, a finishing body disposed between the first and second sides, where the finishing body is made from a flexible non-metallic material capable of conforming to a crankshaft bearing surface and adjacent side.

Another object of the present invention is to provide a flexible finishing shoe for a finishing arm wherein the finishing body of the finishing shoe has a shape which generally matches the shape of a workpiece bearing surface.

The above objects and other objects, features and advantages of the present invention are readily apparent from the following detailed description of the best mode for carrying out the invention to be taken in connection with the accompanying drawings.

DETAILED DESCRIPTION OF THE INVENTION

Figure 1:
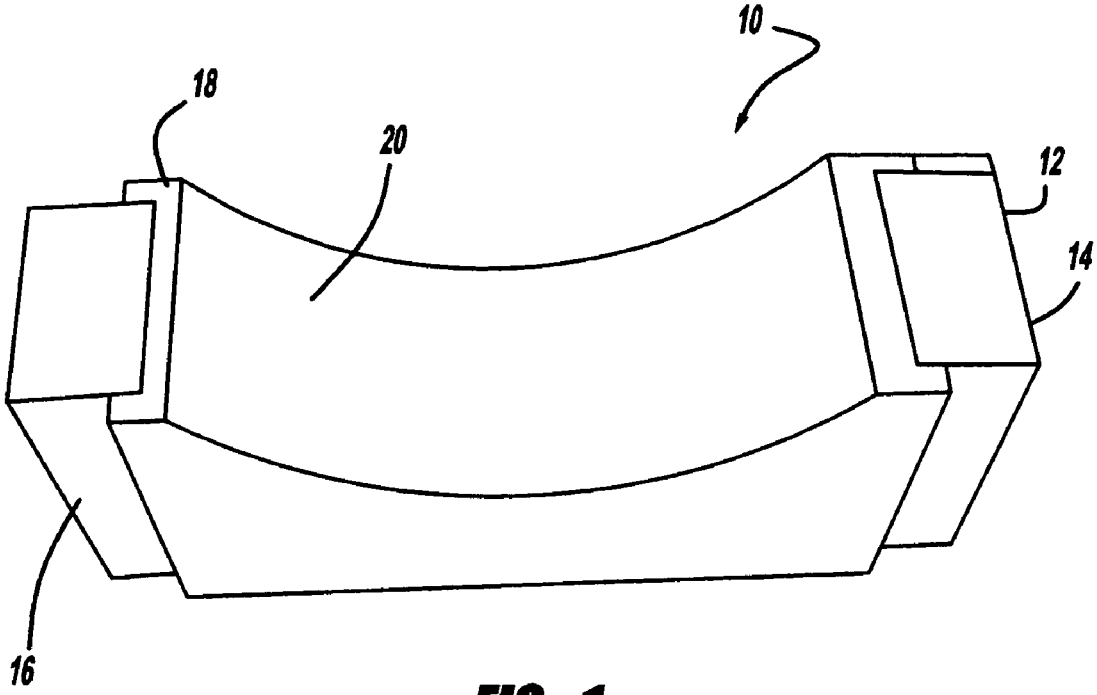
FIG. 1 is a perspective view of the flexible finishing shoe of the present invention.

Referring now to FIG. 1, there is shown a flexible finishing shoe 10. Flexible finishing show 10 includes a shoe base 12 having a first side 14 and an opposing second side 16. A finishing body 18 is disposed between first side 14 and an opposing second side 16. Finishing body 18, in the preferred embodiment, is manufactured from a flexible non metallic material. While not limiting the present invention, it is contemplated by the present invention to manufacture the finishing body from a urethane material with a hardness is a range form 30 to 95 durometer.

Figure 2:
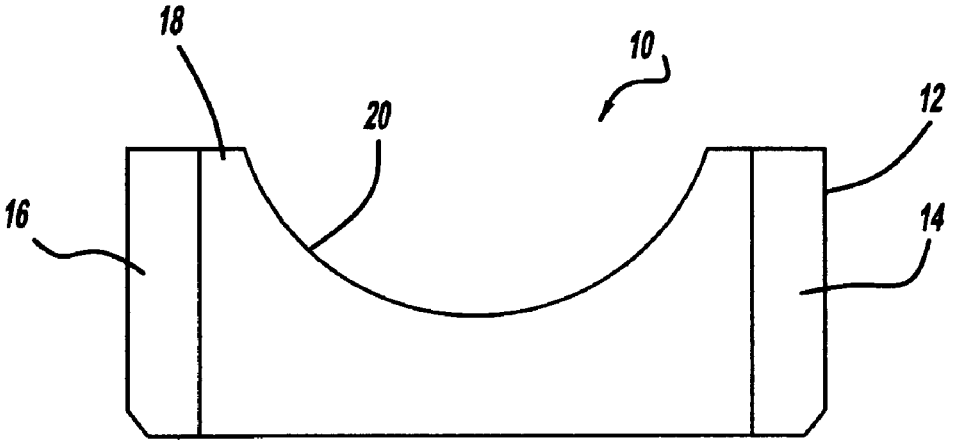
FIG. 2 is a side view of the flexible finishing shoe of the present invention.
Figure 5:
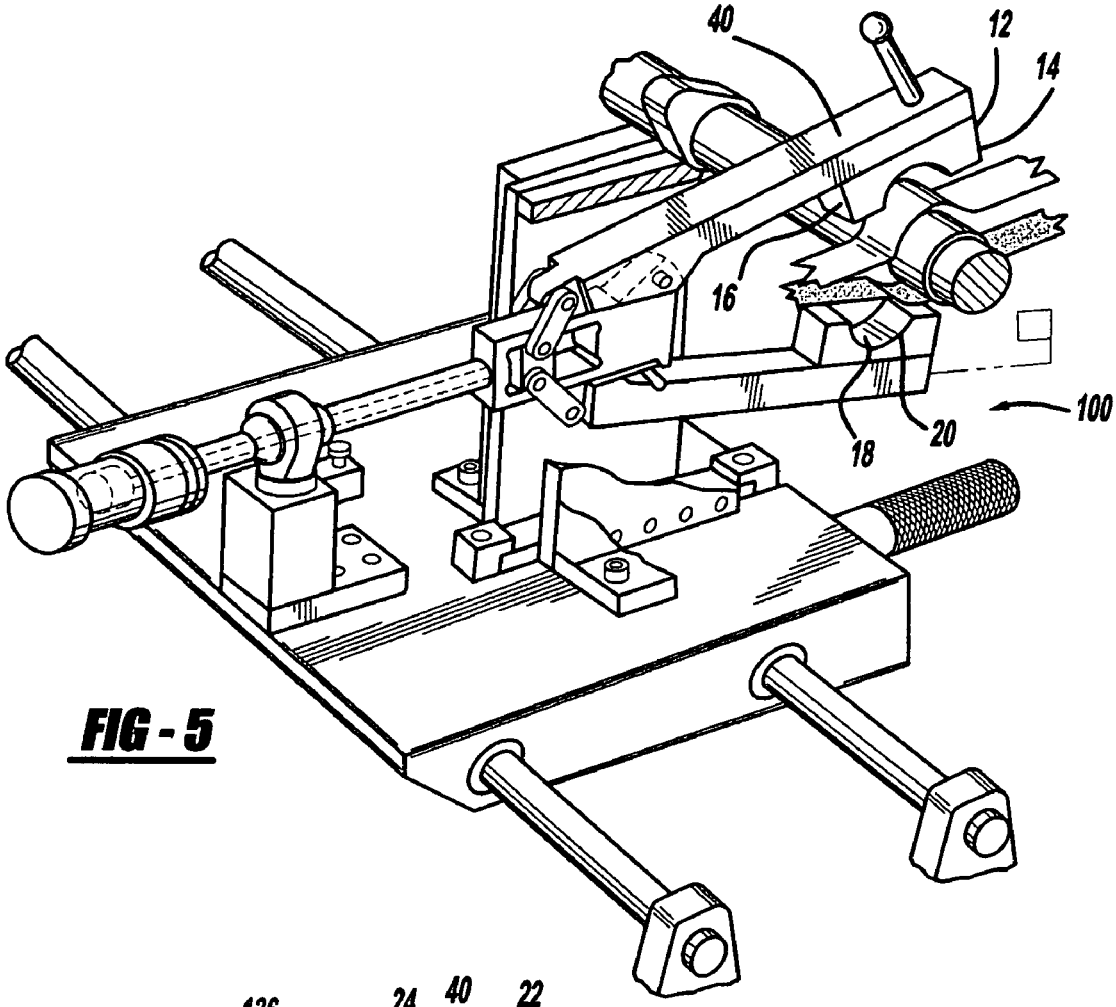
FIG. 5 is a perspective view of a finishing machine using the flexible finishing shoe of the present invention and FIG. 6 is side view of a finishing machine using the flexible finishing shoe of the present invention.

The finishing body 18 is insert molded onto the shoe base 12 in the preferred embodiment. Other forms of attachment such as use of adhesive or mechanical means such as screw attachments and rivet-like attachments may also be used. Referring to FIGS. 1 and 2, it is shown that the finishing body 18 has a contact surface 20. This contact surface 20 is semi-circular is cross section and generally matches or conforms to the shape of the intended bearing surface to be finished. The finishing body, when insert molded to the shoe base, provides a solid continuous flexible finishing shoe which is capable of attachment to a surface polishing tool 100 as shown in FIG. 5. As shown in FIG. 2, the finishing body 18 is shaped to be capable of continuously conforming to at least a 150 degree segment of the circumference of the bearing surface and adjacent side.

Figure 3:
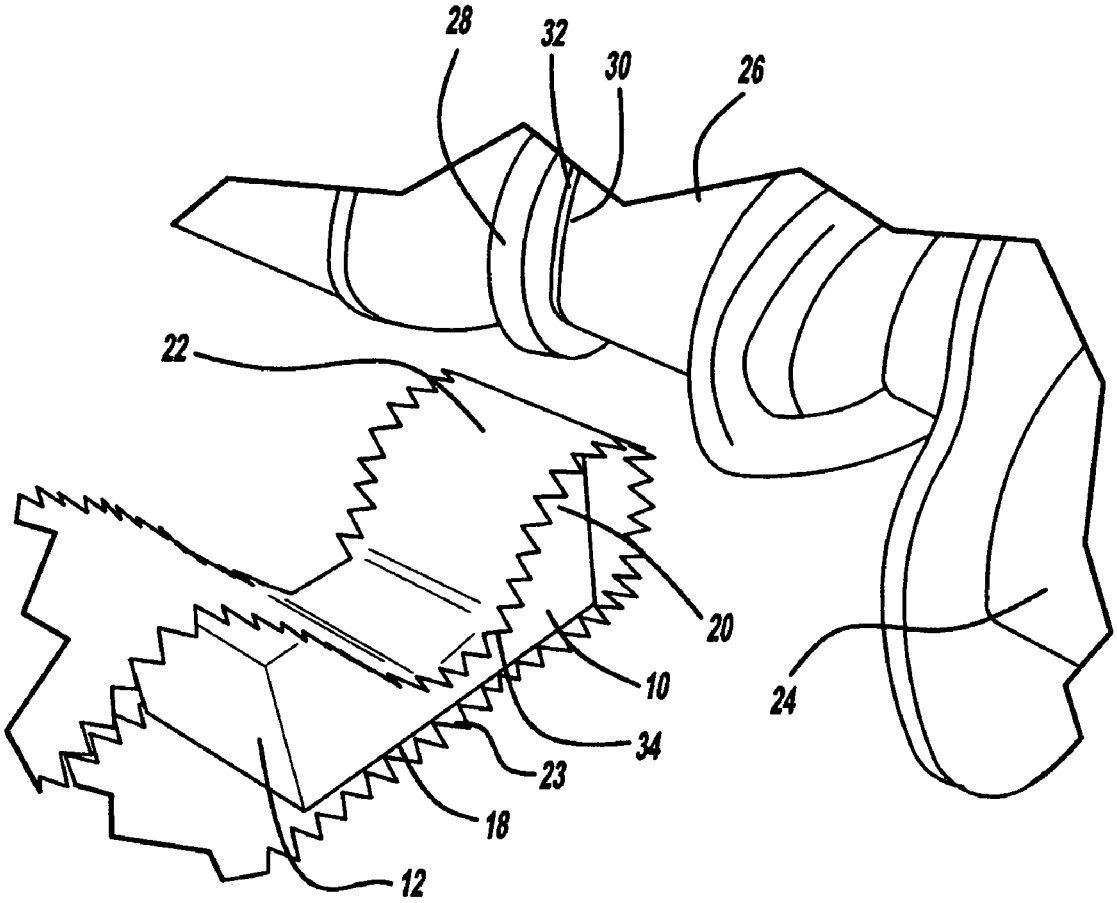
FIG. 3 is an exploded view of the flexible finishing shoe of the present invention shown with a crankshaft bearing surface and finishing tape in a non-operational mode illustrating the position of the finishing tape in an operational mode.

Referring now to FIG. 3, there is shown the flexible finishing shoe 10 with the finishing tape 22 disposed adjacent the flexible finishing shoe 10. The flexible finishing shoe 10 is shown in an exploded view illustrating the proper placement of the finishing tape 22. The abrasive tape 22 includes a wavy edge 23 when used with the flexible finishing shoe 10. There is shown crankshaft 24 having a bearing surface 26. It is known in the art that when the bearing surface 26 meets the crankshaft counterweight 28, the bearing surface 26 has a curved or radiused portion 30. This radiused portion 30 does not have a squared or flat corner.

The radiused portion 30 is necessary to increase crankshaft strength in this area and reduce the possibility of stress risers. This radiused portion 30 is sometimes known in the art as a fillet radius, as shown because it is a tangental fillet radius tangent with the bearing outside diameter. The crankshaft bearing surface 26 and radiused portion are preliminarily machined together on the crankshaft 24, but it is difficult in the industry to keep the transition from the bearing surface outside diameter 32 and raduised portion 30 in a continuously smooth surface. If there is any misalignment there will be a line or imperfection and the line or imperfection creates stress riser (not shown).

Figure 4:
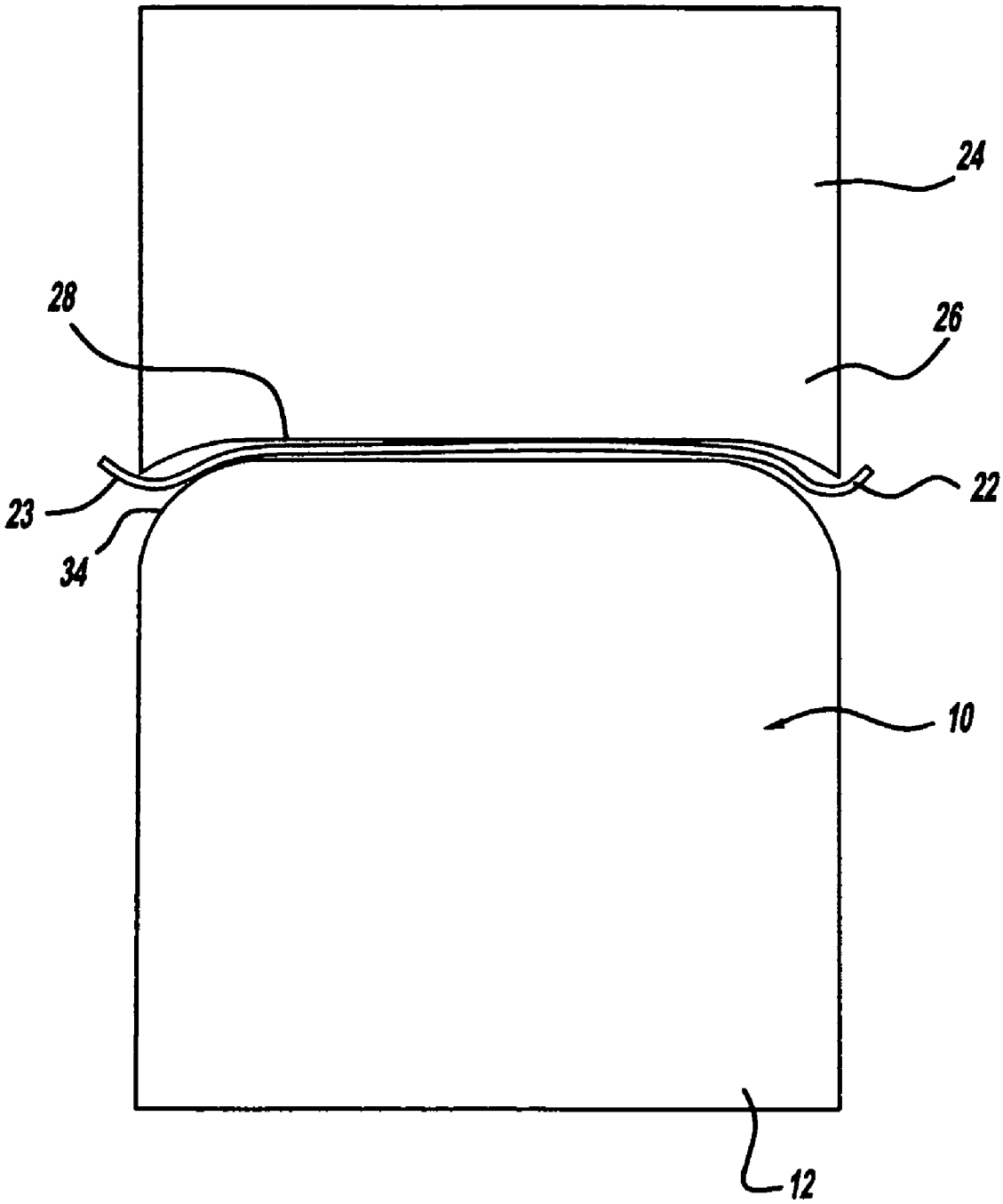
FIG. 4 is side view of the flexible finishing shoe of the present invention shown with a bearing surface and finishing tape.

Referring to FIG. 4, abrasive tape film 22 is wrapped around the crankshaft bearing surface 26 and pressure is applied to the flexible finishing shoe 10. In operation, as illustrated in FIG. 3, the wavy edge 23 of the abrasive tape 22 covers the radiused edge 34 of the flexible finishing shoe. Wavy edge 23 is known in the art as a scalloped edge and allows the abrasive tape 22 to blend in the radius without ripping or tearing.

The abrasive tape 22, when the flexible finishing shoe is operational and finishing pressure applied, wraps around the bearing surface 26 and the wavy edge 23 contacts the radiused portion 30. In the best mode, the abrasive tape 22 includes the wavy edge 23, as a straight edge film would tear, rip or fray when it is pressed into radiused portion 30 and then also wrapped around the bearing surface 28.

In the best mode, the finishing body 18 is designed to mate or correspond directly to the shape and dimensions as the bearing surface 26 and radiused portion 30. In the finishing operation, when the abrasive tape 22 and finishing shoe are applied under finishing pressure to the bearing surface 26, the abrasive tape 22 is pushed into direct contact with the bearing outside diameter and radiused portion 30 with a consistent even pressure over the entire surfaces. This even pressure provides for an even material removal from the bearing surface 28. This even pressure precipitated by the corresponding shape of the finishing shoe greatly reduces the possibility of lines or cracks at the tangent point of the bearing outside diameter and the beginning of the radius portion 30.

Figure 6:
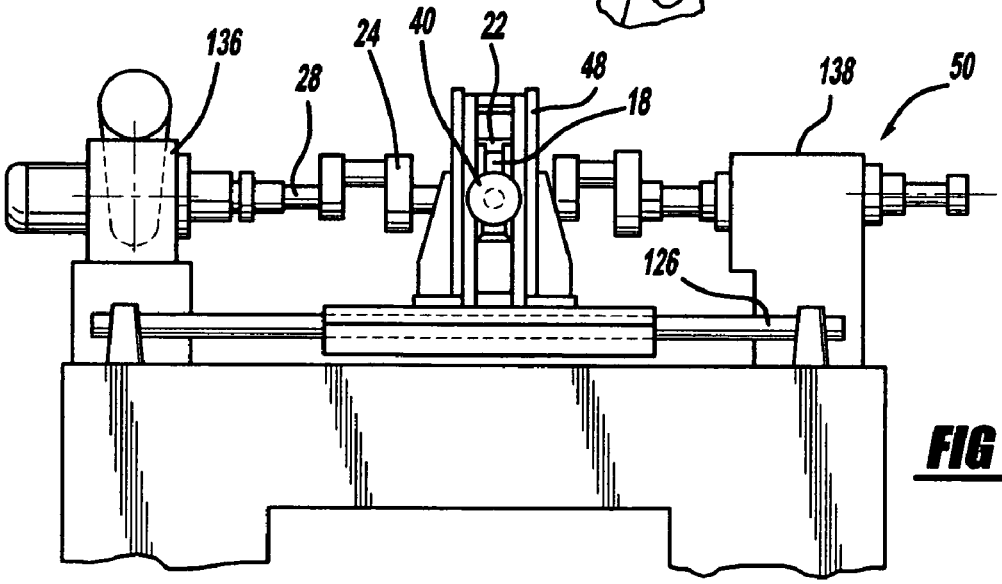

FIG. 5 illustrates a flexible finishing shoe 10 attached to a finishing arm 40. U.S. Pat. No. 5,437,125, is herein incorporated by reference and describes a finishing arm affixed to finishing machine. Finishing arm 40 has affixed thereto a shoe base 12. The shoe base has a first side 16 and opposing second side 16. In figure the finishing body 18 and contact surface 20 are shown in a disengaged state. FIG. 6 illustrates a finishing arm assembly with shoe affixed to a finishing arm assembly 48 attached to a finishing machine 50. FIG. 6 illustrates a finishing machine including a headstock 136 and a tail stock 138 for use in rotating the crankshaft 24 about a rotational center axis in a lathe type fashion, also described in U.S. Pat. No. 5,437,125. In a finishing operation, crankshaft 24 is rotated by finishing machine 50. While rotating, finishing shoe 10 is moved into contact with the abrasive tape 22 under a finishing pressure, applied by the finishing arm 40 and moved in contact with bearing surface 26. The contact removes material from bearing surface 26 in a controlled manner as defined by the speed on the bearing surface 26 rotation, finishing tape abrasiveness, pressure applied to the bearing surface 26, shape of the contact surface 20 and the flexiblility or hardness of the flexible finishing shoe.

While the best mode for carrying out the invention has been described in detail, those familiar with the art to which this invention relates will recognize various alternative designs and embodiments for practicing the invention as defined by the following claims.

What is claimed is:

1. A flexible finishing shoe for finishing a workpiece have a bearing surface and an adjacent side, said flexible finishing shoe comprising:

a shoe base having a first side and an opposing second side; and a one piece finishing body disposed between said first and second sides, said finishing body made from a flexible non-metallic material capable of continuously conforming to at least a 150 degree segment of the circumference of said bearing surface and adjacent side.

2. The flexible finishing shoe of claim 1 wherein said finishing body is manufactured from a urethane material.

3. The flexible finishing shoe of claim 1 wherein said finishing body has a shape which generally matches the shape of a workpiece bearing surface.

4. The flexible finishing shoe of claim 1 wherein said finishing body is manufactured from a urethane material and said finishing body has a shape which conforms to the shape of a workpiece bearing surface configuration.

5. The flexible finishing shoe of claim 1 wherein said workpiece has a fillet radius extension and said finishing body has a shape which generally matches the shape of a workpiece bearing surface such that said finishing body forms a fillet radius recess for finishing said fillet radius extension.

6. The flexible finishing shoe of claim 1 wherein said finishing body has a hardness in a range from 30 to 95 durometer.

7. The flexible finishing shoe of claim 1 wherein said finishing body is insert molded onto said shoe base.

8. The flexible finishing shoe of claim 1 wherein said finishing body has a shape which is slightly smaller than the shape of a workpiece bearing surface.

9. A finishing arm assembly for finishing a workpiece having a bearing surface, said finishing arm comprising:

an abrasive means for finishing the bearing surface;

a first finishing arm having a finishing shoe; and a second finishing arm having a flexible finishing shoe disposed opposite said finishing shoe of said first finishing arm wherein said flexible finishing shoe comprises a shoe base having a first side and an opposing second side, a one piece finishing body disposed between said first and second sides, said finishing body made from a flexible non-metallic material wherein said first and second finishing arms are movable about said workpiece such that said flexible finishing shoe contacts said abrasive means for finishing which in turn contacts said bearing surface to finish said bearing surface, said finishing body capable of continuously conforming to at least a 150 degree segment of the circumference of the bearing surface.

10. The finishing arm assembly of claim 9 wherein said finishing body is manufactured from a urethane material.

11. The finishing arm assembly of claim 9 wherein said finishing body has a shape which generally matches the shape of a workpiece bearing surface configuration.

12. The finishing arm assembly of claim 9 wherein said workpiece has a fillet radius extension and said finishing body has a shape which generally matches the shape of a workpiece bearing surface such that said finishing body forms a fillet radius recess for finishing said fillet radius extension.

13. The finishing arm assembly of claim 9 wherein said finishing body has a hardness in a range from 30 to 95 durometer.

14. The finishing arm assembly of claim 9 wherein said finishing body is insert molded onto said shoe base.

15. The finishing arm assembly of claim 9 wherein said finishing body has a shape which is slightly smaller than the shape of a workpiece bearing surface.

16. A finishing arm assembly for finishing a workpiece having a bearing surface, said finishing arm comprising:

an abrasive means for finishing said bearing surface;

a upper finishing arm having an upper flexible finishing shoe, said upper flexible finishing shoe comprising a shoe base having a first side and an opposing second side and a finishing body disposed between said first and second sides, said finishing body made from a flexible non-metallic material; and a lower finishing arm having a lower flexible finishing shoe disposed opposite said upper finishing shoe of said upper finishing arm wherein said lower flexible finishing shoe comprises a shoe base having a first side and an opposing second side, a finishing body disposed between said first and second sides, said finishing body made from a flexible non-metallic material wherein said upper and lower finishing arms are movable about said workpiece such that said upper and lower flexible finishing shoes contact said abrasive means for finishing which in turn contacts said bearing surface to finish said bearing surface and wherein said finishing body of said upper and lower flexible finishing shoes has a fillet radius extension and one of said upper or lower flexible finishing shoes has a shape which generally matches the shape of a workpiece bearing surface such that said finishing shoe forms a fillet radius recess for finishing said fillet radius extension.

17. The finishing arm assembly of claim 16 wherein said finishing body of said upper and lower flexible finishing shoes is manufactured from a urethane material.

18. The finishing arm assembly of claim 16 wherein said finishing body of said upper and lower flexible finishing shoes has a shape which generally matches the shape of a workpiece bearing surface configuration.

19. The finishing arm assembly of claim 16 wherein said finishing body of said upper and lower flexible finishing shoes is manufactured from a polyurethane material having a hardness in a range from 30 to 95 durometer.

20. The finishing arm assembly of claim 16 wherein said finishing body of said upper and lower flexible finishing shoes has a shape which is slightly smaller than the shape of a workpiece bearing surface.

* * * * *

UNITED STATES PATENT AND TRADEMARK OFFICE

CERTIFICATE OF CORRECTION

PATENT NO. : 7,169,028 B1 
APPLICATION NO. : 11/265262
DATED : January 30, 2007
INVENTOR(S) : Kenneth A. Barton, II It is certified that error appears in the above-identified patent and that said Letters Patent is hereby corrected as shown below:

Abstract, Line 1 - Please delete “have” and insert -- having --;

Col. 2, Line 21 - Please delete “raduised” and insert -- radiused -- after “the”;

Col. 3, Line 3 - Please delete “form” and insert -- from -- after “range”;

Col. 3, Line 42 - After “creates” please insert -- a --;

Col. 4, Line 10 - Please delete “16” and insert -- 14 -- after “a first side”;

Col. 4, Line 11 - After “figure” please insert -- 5 --;

Col. 4, Line 35, Claim 1 - Please delete “have” and insert -- having -- after “workpiece”;

Signed and Sealed this

Fourth Day of September, 2007

JON W. DUDAS
*Director of the United States Patent and Trademark Office*